United States Patent [19]

Thuries et al.

[11] 4,421,962

[45] Dec. 20, 1983

[54] COMPRESSED GAS CIRCUIT-BREAKER

[75] Inventors: Edmond Thuries, Pusignan; Pierre-Paul Sigward, Villeurbanne; Marcel Besson, Eyzin-Pinet; Doan P. Van, Meyzieu; Dante Nicoloso, Jonage, all of France

[73] Assignee: Alsthom-Atlantique, Paris, France

[21] Appl. No.: 286,220

[22] Filed: Jul. 23, 1981

[30] Foreign Application Priority Data

Jul. 23, 1980 [FR] France ..... 80 16222
Mar. 31, 1981 [FR] France ..... 81 06444

[51] Int. Cl.[3] ..... H01H 33/16
[52] U.S. Cl. ..... 200/144 AP; 200/148 R
[58] Field of Search ..... 200/144 AP, 148 R

[56] References Cited

U.S. PATENT DOCUMENTS 2,792,476 5/1957 Westinghouse .
3,211,868 10/1965 General Electric .
4,338,500 7/1982 Pham Van et al. ..... 200/144 AP

FOREIGN PATENT DOCUMENTS 880010 7/1949 Fed. Rep. of Germany .
2450501 9/1980 France .

*Primary Examiner*—Robert S. Macon

[57] ABSTRACT

The invention relates to a compressed gas circuit-breaker with a tubular stationary contact, a tubular moving contact, a device for inserting a resistance when the circuit-breaker closes, the insertion device and the resistance being disposed in a coaxial casing, said device being controlled by the moving contact of the circuit-breaker, the insertion device (19) being of the semi-mobile type and having a first means (51, 52) for damping its closing and a second means (50, 44) for delaying its opening when the circuit-breaker opens, wherein the first means (51, 52) and the second means (50, 44) are of the type which operate by pressure reduction. Application to circuit-circuit breakers which equip very high tension lines.

11 Claims, 7 Drawing Figures

COMPRESSED GAS CIRCUIT-BREAKER

The invention relates to a compressed gas circuit-breaker and more particularly to a circuit-breaker including a device for inserting a resistance only on closing.

BACKGROUND OF THE INVENTION

It is known to use resistances to reduce overvoltages which may occur in very high tension grids when closing or re-closing a long line which has remained charged by interrupting the capacititive current.

The value of such a resistance must be close to that of the characteristic wave impedance of the line. However it is advantageous to be able to vary the duration of resistance insertion depending on the grid in question, and a circuit-breaker is more versatile if it can be adapted without great modification to shorter or longer insertion times.

To obtain this result, the resistances used are switched in and out in an auxiliary chamber controlled by operating units which are independent of, or at least adjustable with respect to, the unit which operates the main chamber of the circuit-breaker. However, this leads to bulky equipment which is more expensive and requires two chambers and two operating units.

If both the main chamber and the auxiliary chamber are placed in the same casing, this casing is very bulky.

In the case of a compressed gas operating unit, the delay of the main chamber can be adjusted relative to the auxiliary chamber by use of dead volumes and consequently the duration of insertion can also be adjusted. If the operating unit is mechanical, as is generally the case with auto-compression sulphur hexafluoride type circuit-breakers, it is necessary to have two operating units if the resistance is not to be in circuit at the time of release.

The invention aims to produce a compressed gas circuit breaker with a device for inserting a resistance only on closing there being only one operating unit and the circuit-breaker being compact.

SUMMARY OF THE INVENTION

The invention provides a compressed gas circuit-breaker with a tubular stationary contact, a tubular moving contact, a device for inserting a resistance when the circuit-breaker closes, the insertion device and the resistance being disposed in a coaxial casing, said device being controlled by the moving contact of the circuit-breaker, the insertion device being of the semi-mobile type and having a first means for damping its closing and a second means for delaying its opening when the circuit-breaker opens, wherein the first means and the second means are of the type which operate by pressure reduction the first means and the second means including in common a bell-shaped part which is integral with the insertion contact, said bell-shaped part co-operating with a stationary drum which slides in the bell-shaped part to provide damping on closing, said bell-shaped part having a flange which, when the circuit-breaker closes, can engage in a stationary bore and can slide therein to delay the opening of the insertion device when the circuit-breaker opens. The first means includes a device for adjusting the spacing between a semi-mobile insertion contact of the insertion device and a moving insertion contact of the moving contact, said insertion device being subjected to the opposing action of a spring which urges in the opening direction.

Preferably the circuit-breaker has a burning tip disposed coaxially with the stationary main contact and the moving main contact. The burning tip is fixed to the stationary contact by means of a support with three radial arms with three stringers in the gaps between them, the three stringers supporting the semi-mobile insertion contact.

The resistance can be constituted by a central stack disposed in series with several peripheral stacks which are connected in parallel. The linear resistance of the peripheral stacks as a whole is equal to that of the central stack.

According to one variant, the circuit-breaker includes a second resistance and a contact for inserting the second resistance in parallel with the first resistance, the insertion contact of the second resistance being integral with the insertion device of the first resistance.

BRIEF DESCRIPTION OF THE DRAWINGS

Embodiments of the invention are described by way of example and with reference to the accompanying drawings, in which.

DESCRIPTION OF PREFERRED EMBODIMENTS

Figure 1:
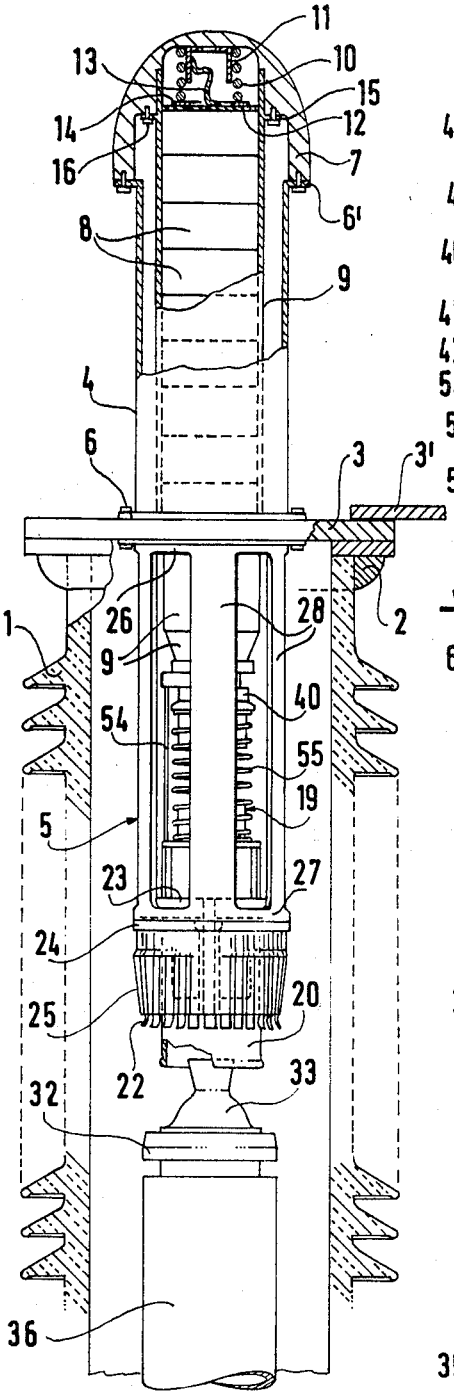
FIG. 1 is a partial schematic cross-section view of a circuit-breaker in accordance with the invention in the open position.

An insulating casing referenced 1 in the figures is made for example of a ceramic substance for an auto-compression sulphur hexafluoride circuit-breaker with mechanical transmission. The insulating casing 1 is closed at the lower end by a housing not illustrated which contains the jacks or other mechanical actuators. The upper end has a ring 2 and a plate 3 which carries an outer connection terminal 3'.

A tubular stationary main contact unit 5 is fixed to the lower portion of the plate 3 and a tubular jacket 4 which contains a resistance which, as a whole, is referenced 8, is sealed to the upper portion of said plate. Components 4 and 5 can advantageously be assembled together before being installed in the casing 1. The jacket 4 is made of metal, e.g. pure aluminium or aluminium alloy and has flanges 6 and 6' at its ends. A cap 7 made of a conductive material is fixed onto the upper flange 6'. The resistance 8 is formed by a stack of cylindrical disk coils and is placed in an insulating cylinder 9 which is insensitive to the decomposition products of sulphur hexafluoride. A spring 10 placed around a guide 11 which is integral with the cap 7 bears against a plate 12 which compresses the disk coils of the resistance 8 and thereby provides good contact between them. Braiding 13 shunts the spring and an insulating washer 14 is interposed between the spring 10 and the plate 12 so as to prevent the current from passing through the spring. When the tube 9 is assembled by bolts 15 on a shoulder 16 of the cap 7, the spring 10 is compressed. Thus it is possible to make the jacket 4 and the insulating cylinder 9 strictly coaxial with each other.

The lower end of the cylinder 9 is frusto-conical and is closed by a frusto-conical end piece 17 with a central shoulder that supports a guide rod 18 on which a semi-mobile insertion device 19 slides, the lower end of said insertion device carrying a tubular contact 20 for insertion of the resistance 8.

The upper stationary contact includes the contact unit which supports both a set of axially-extending main contact fingers such as 22 spaced out around its periphery and an axially-extending conductive tube 21 coaxially fixed to the centre of the contact unit by means of three radial arms 60 on a support 23. The end of said conductive tube 21 constitutes a burning tip 29.

The tubular insertion contact 20 is connected to the insertion device 19 by three stringers 61 disposed in the gaps in between the three radial arms 60. The stringers 61 may be formed by cutting them out longitudinally from a tube which also constitutes the contact 20.

The moving contact of the circuit-breaker includes a hollow moving contact tube 30 which serves as a passage for the gases ionized at the time of interruption and which is pulled towards the arm or pushed back upwards by a device which is not shown and is housed in a jacket. It also includes a moving lower contact unit 31 fixed on the tube 30 and supporting concentrically from the periphery of the centre:

The main moving contact 32 in the form of a ring; an insertion moving contact 62 in the form of a ring; a blast nozzle 33; and fingers of moving burning tips 34.

A stationary piston 35 co-operates with a blast cylinder 36 which is integral with the moving contact unit 31. The casing 1 is filled with sulphur hexafluoride at a pressure of about three atmospheres.

The upper stationary contact unit 5 is in the form of a perforated tube-shaped conductor which has a short cylindrical sleeve 26 on one end and a similar sleeve 27 on the other end, said sleeves being connected together by six strips 28 and being formed by being cut out longitudinally from said conductive tube.

The upper sleeve 26 allows connection to the plate 3. The lower sleeve 27 is connected firstly to a tubular contact unit 24 and secondly to the arms 60 of the support 23 which arms have very rounded upper surfaces. The tube 21 is screwed onto the support 23. The main stationary contact is constituted by the fingers 22 which are urged inwardly by springs 25, the movement of the fingers 22 towards the centre of the chamber being limited by the tubular contact unit 24. The fingers are made of flat copper strips with curved end portions to obtain proper guidance when coming into contact with the main moving contact 32.

A damping device 40 whose body has a central bore 44 ending in a groove 45 which communicates with lateral vents 46 spaced out around the periphery of the groove 45 is fixed on the piece 17 which closes the insulating cylinder 9.

The guide rod 18 has a circular shoulder 47 for clamping together circular diaphragm 41 with holes 42 in it, a resilient indiarubber seal 48 and a ring 49 to immobilize the seal 48.

The resilient seal 48 normally stops the holes 42 of the diaphragm 41 to form a valve. The insertion device 19 slides on the guide rod 18.

At its upper end, the insertion device 19 has a male portion which is constituted by a flange 50 whose diameter corresponds to that of the bore 44 and at its lower end a female portion constituted by a bell-shaped part 51 which co-operates with a drum 52 fixed at the end of the guide rod 18; stacked washers 53 allow the position of the drum 52 to be adjusted relative to that of the body of the damping device.

The insertion device 19 is guided in its movement along the rod 18 by a rigid rod 54 which is integral with the body of the damping device 40 and slides in a notch in the base of the bell-shaped part 51. A spring 55 which bears against the periphery of the body of the damping device 40 normally pushes the insertion device 19 back against the drum 52 or in the direction thereof depending on its position.

Figure 4:
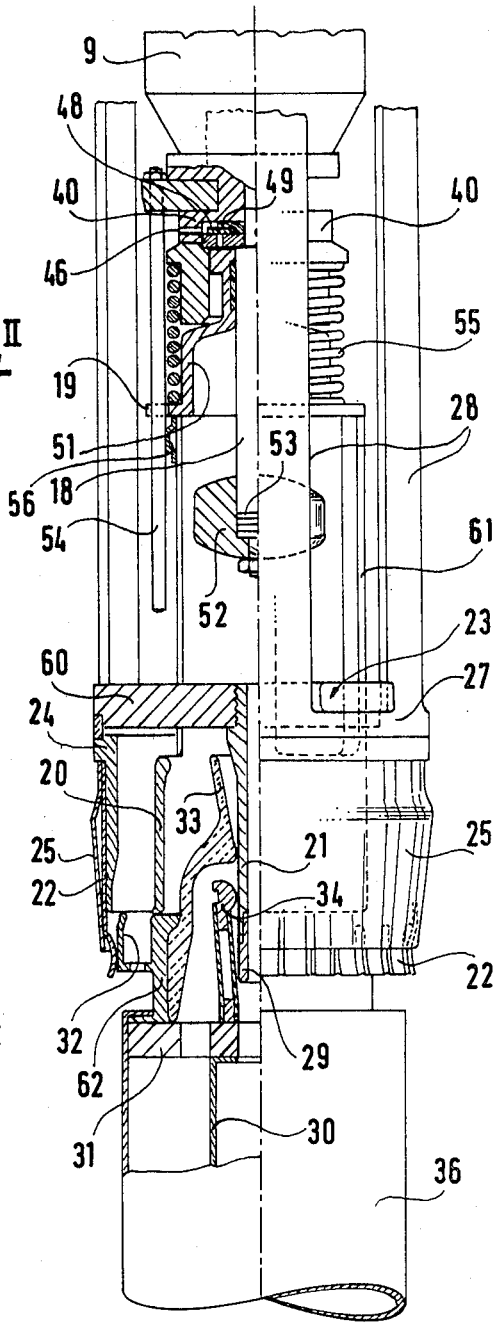
FIG. 4 is a partial schematic view of the circuit-breaker of FIG. 2 in the closed position.

The circuit-breaker operates as follows:

In the circuit-breaker closed position illustrated in FIG. 4, current passes successively through the parts 3, 5, 27, 24, 22, 32, 31, 30.

Figure 2:
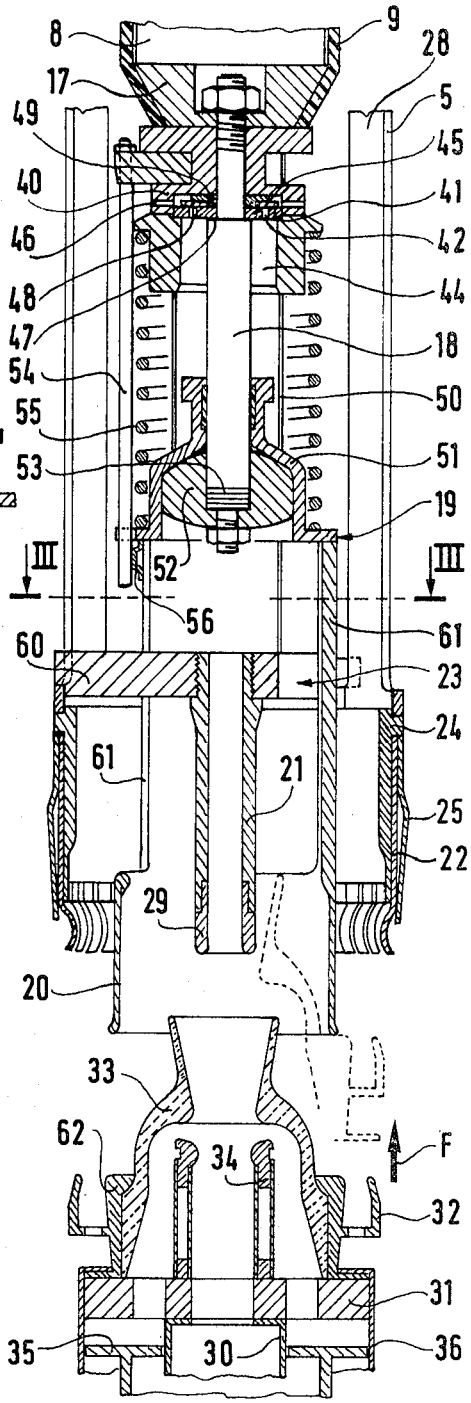
FIG. 2 is a partial schematic view on a larger scale of the lower portion of the circuit-breaker of FIG. 1 along the line II—II of FIG. 3.
Figure 3:
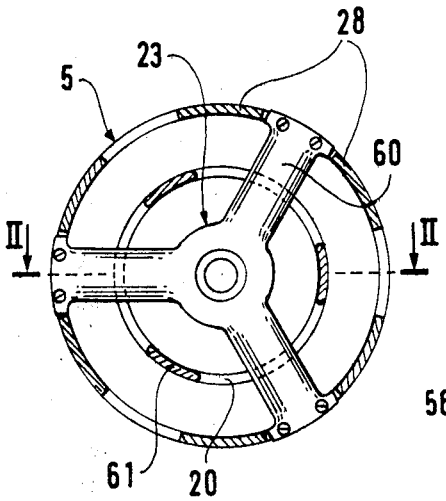
FIG. 3 is a partial schematic cross-section view of the circuit-breaker of FIG. 2 along line III—III.

In the circuit-breaker open position illustrated in FIGS. 1 and 2, tension is applied across the main moving contact 32 with its burning tip 34 and the insertion contact 20 with its burning tip 29, the shortest distance being that which separates the moving insertion contact 62 and the insertion contact 20.

When the circuit-breaker main moving contact closes, moving from bottom to top in the direction shown by arrow F in FIG. 2, it comes into contact with the insertion contact 20 before the burning tips 34 and 29 touch each other, as illustrated in broken lines in the right-hand portion of FIG. 2. There may be arcing before the parts actually make contact.

The semi-mobile insertion contact 20 is then pushed back upwards against the action of the spring 55, but there is no bouncing between the contacts 20 and 32 due to gas pressure reduction damping achieved by sliding the bell-shaped part 51 on the drum 52, the gas passing between the two parts 51 and 52 through the clearance left between them. From the instant when metallic contact occurs between the contacts 62 and 20, or from the instant of preliminary arcing, if any, the current passes through the resistance 8, said current passing successively through the components 62, 20, 51, 56, 54, 40, 17, 8, 12, 13, 7, 4, 6, 3, the part 56 constituting a sliding contact interposed between the bell-shaped part 51 and the rod 54. The potential corresponding to the voltage drop in the resistance 8 appears between a first group of components 22, 5, 6, the strips 28 of the contact unit 5, the support 23, the tube 21, the burning tip 29, and a second group of components comprising the stringers 61 of the insertion contact 20 together with the components of the moving contact. To be able to withstand the voltage, adjacent parts are of rounded shape so as to improve the distribution of the electric field and the stringers 61 and the insertion contact 20 are as thin as possible.

Continuing its upward movement, the moving burning tip 34 touches the stationary burning tip 29 and at that instant or at a prior instant of arcing between these two parts if the voltage at the terminals of the resistance is not zero, the resistance 8 is shunted, the current passing via parts 34, 29, 21, 23, 5, 6, 3, whose path is of very low resistance; the current is finally established through the circuit-breaker. At the end of its stroke, the main moving contact 32 comes into contact with the fingers 22, the flange 50 enters the bore 44, gas pressure damping is slight since the gas which is compressed escapes through the holes 42 in the diaphragm 41 which is separated from the seal 48 which is pushed back and acting as a valve. The gas also escapes through the vents 46.

The insertion time can be adjusted and increased by adding washers 53 which move the drum 52 downwards and hence move the part 20 by the same distance without changing the kinematics or the movement speed of the moving contact assembly.

When the circuit-breaker opens, the moving contact assembly moves in the opposite direction, i.e. from top to bottom. There is firstly a sudden separation of the insertion contact 20 from the moving contact 62 then of the main contact 22 from the moving contact 32. The downward movement of the contact 20 is obtained by the action of the spring 55 on the insertion device 19 but the movement is very slow to begin with since the diaphragm 41 and the seal 48 operate like a gas pressure reduction non-return valve, the gas entering only due to the clearance between the flange 50 and the bore 44 and to the negligible leaks at the seal 48.

The separation of the contacts of the circuit-breaker ends between the burning tips 34 and 29 and at that instant the distance between the contacts 20 and 62 is sufficient to avoid any further arcing between the contacts 20 and 62 and between the moving contacts 32 and 62. The movement of the insertion device 19 and of the contact 20 speeds up after the flange 50 leaves the bore 44 of the body of the damping device 40 and is then gas pressure damped when the bell-shaped part 51 surrounds the drum 52.

The clearances and the damping lengths at the drum 52 provide:

- no bouncing at the time of the shock between the moving contact 62 and the insertion contact 20 on closing;
- a rest position for the bell-shaped part 51 on the drum 52 after 0.1 to 0.2 seconds so that the insertion contacts will be in place ready for another closing operation after an opening and closing cycle with an isolation time which lasts for about 0.2 to 0.3 seconds. The drum 52 has a rounded shape so as to improve gas pressure damping and to promote evacuation of the ionized gases produced by the arc and blasted by the compressed gas in the cylinder 36 which gas escapes via the tubes 21 and 30 at the time of opening.

The advantages of the circuit-breaker are as follows:

The cut-out chamber of the circuit-breaker, the resistance and its insertion device are disposed in the same casing.

It is possible to vary the instant of insertion of the resistance and the duration thereof by adding or removing shims or washers 53.

The insertion contact is prevented from bouncing as this would cause an arc which would damage the contacts and could cause transient electric phenomena.

Figure 5:
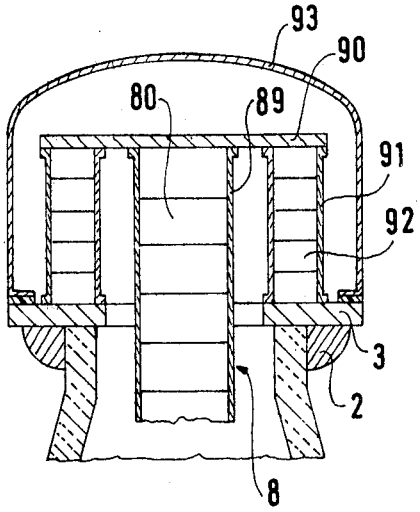
FIG. 5 is a schematic view of the upper portion of the circuit-breaker showing a variant of the closing resistance.

FIG. 5 shows a variant which allows the height of the upper portion of the circuit-breaker to be reduced.

The resistance 8 is then produced by means of a plurality of insulating tubes:

- a central tube 89 analogous to but shorter than the tube 9 in FIG. 1 bears against a conductive plate 90 which rests on four peripheral insulating tubes 91 whose inner cross-section is substantially equal to one fourth of the inner cross-section of the tube 89. Each of these tubes contains a stack of resistances 92 whose diameter is half that of the central stack 80. The four stacks of resistances 92 in the tubes 91 therefore have the same end-to-end resistance as the central resistance 80. The four tubes 91 are fixed on the plate 3; a hood 93 seals and surrounds the tubes 91 and 89.

Spring devices similar to those illustrated in FIG. 1 maintain the contact between the resistance disks and electric continuity; thus the current passes through the components 8, 90, 92 and 3.

The advantages of this disposition are as follows:

- no current passes through the hood 93;
- the part which contains the resistance is shorter although its diameter is larger but generally remains within the dimensions of the insulating casing 1.

Instead of disposing four peripheral resistances a different number, e.g. three, but of equivalent total cross-section, could be disposed around the central resistance.

In some cases, it is desirable to limit even further the overvoltages which occur on closing and a possible solution to this problem consists in closing the circuit-breaker in three steps:

- In a first step, the circuit-breaker is closed on a resistance of higher value than that of the characteristic wave impedance of the grid (e.g. on a resistance of 800 ohms for a characteristic wave impedance of 350 to 400 ohms). The overvoltage will thus be more limited than if the circuit-breaker is closed on a resistance whose value is close to the value of the characteristic wave impedance of the grid. However, since this overvoltage is higher the resistance is shunted,
- In a second step, a second resistance of lower value is inserted or—and this is easier—a second resistance is connected to the terminals of the first. This second resistance may be 300 ohms; the equivalent resistance is then 218 ohms, i.e. about half the value of the characteristic wave impedance.
- The third step is to shunt this resistance which leads to a lower overvoltage.

Figure 6:
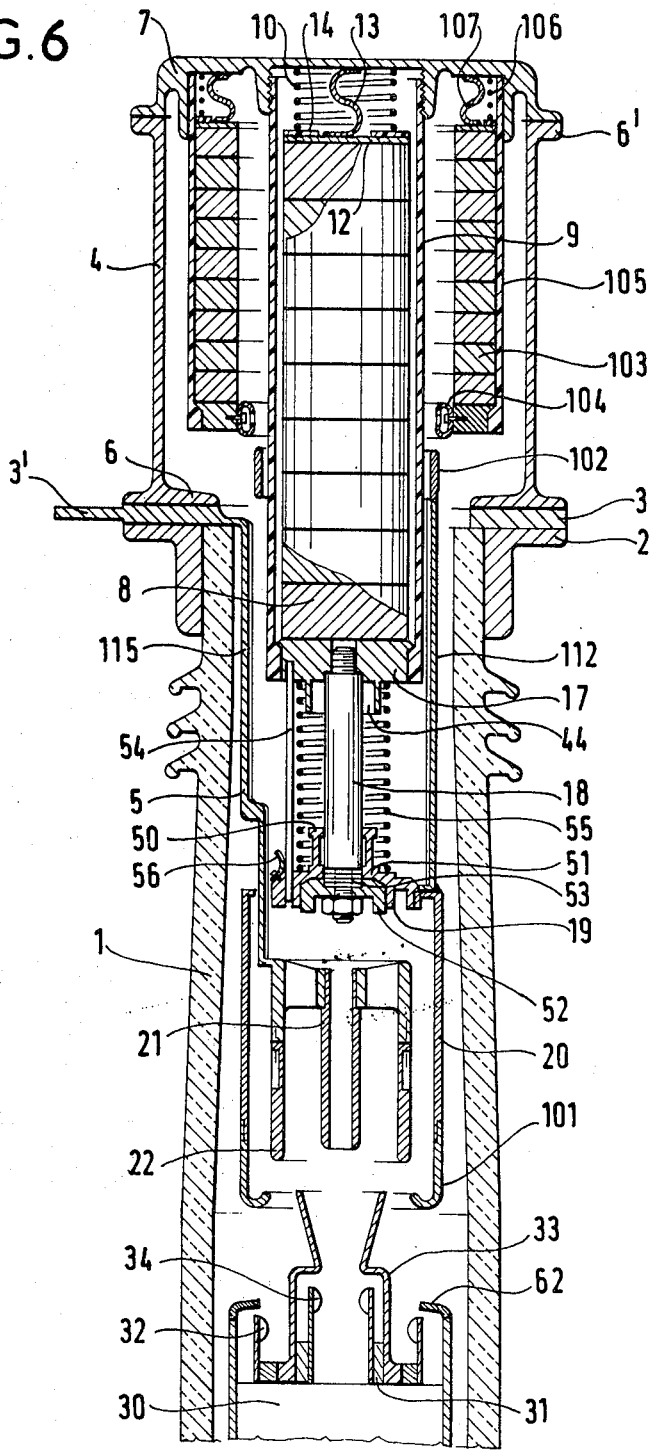
FIG. 6 is a partial schematic cross-section view of a variant of the circuit-breaker.
Figure 7:
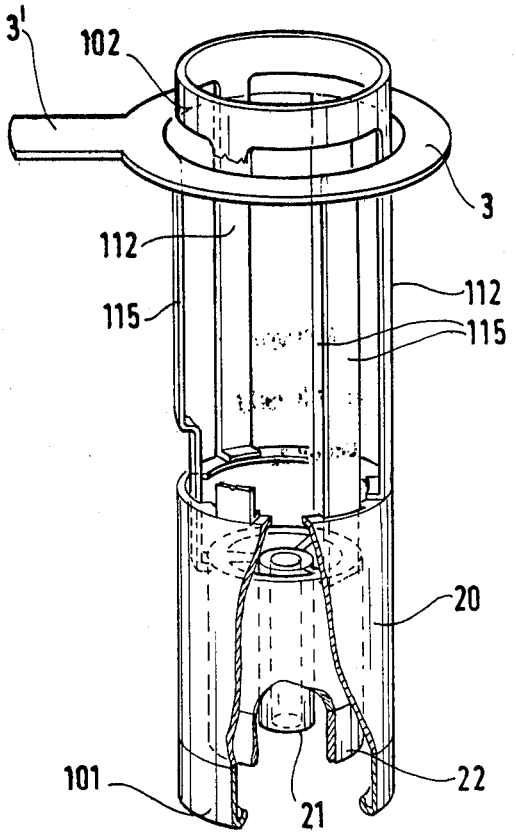
FIG. 7 is a partial perspective view of the insertion contacts and of the stationary contact.

FIGS. 6 and 7 relate to a circuit-breaker modified to allow such three-step closing.

In FIG. 6, components which are common to this figure and to preceding figures each bear the same reference symbol in all the figures.

A second resistance 103 is disposed in the hood; it is constituted by a stack of annular components which are disposed coaxially to the resistance 8. Preferably, the components of the resistance 103 are of rectangular cross-section. The resistance 103 is housed in an insulating casing 105 to insulate it electrically.

The resistance 103 is fixed to the cap 7 of the housing in a manner analogous to that of the resistance 8; it is supported by a spring 106 shunted by a braiding or foil 107.

A contact 104 is disposed at the lower portion of the resistance 103.

The lower end of the cylinder 9 is closed by an end piece 17 whose central shoulder supports a guide rod 18 on which a semi-mobile insertion device 19 slides, the lower end of said insertion device including a tubular contact 20 for insertion of the resistance 8 and its upper end including a tubular insertion contact 102 designed to co-operate with the contact 104. The insertion contact 20 ends in an end piece 101.

The tubular contact 102 is connected to the semi-mobile device 19 by arms 112 which pass between arms 115 of the stationary contact 5 which includes a stationary burning tip 21 and a main contact 22.

Preferably, the stationary contact has three arms disposed at 120 degrees as shown in FIG. 7.

Likewise, the insertion device has three arms 112.

At its upper end, the insertion device 19 has a male portion which is constituted by a flange 50 and a female portion constituted by a bell-shaped part 51 which co-operates with a drum 52 fixed at the end of the guide rod 18; stacked washers 53 allow the position of the drum 52 to be adjusted relative to that of the body of the clamping device.

The insertion device 19 is guided in its movement along the rod 18 by a rigid rod 54 which is integral with the end piece 17 and passes in a notch in the base of the bell-shaped part 51. A spring 55 which bears against the bell-shaped part 51 and against the end piece 17 moves the semi-mobile assembly to the open position of the circuit-breaker. The flange 50 and the bore 44 in which it enters when the circuit-breaker closes constitute together a damping device.

A sliding contact 56 is fixed to the rod 54 and co-operates with the insertion contact 20 to make the current flow through the resistance 8.

The moving contact of the circuit-breaker includes a hollow moving contact tube 30 which serves to allow the passage of the gases ionized when the circuit-breaker cuts out, the contact tube being pulled downwards or pushed upwards by a device not shown and which is accommodated in a housing. It also includes a lower moving contact unit 31 fixed on the tube 30 and concentrically supporting, from the periphery of the center, the main moving contact 32 in the form of a ring, a moving insertion contact 62 in the form of a ring, a blast nozzle 33, and moving burning tip contact fingers 34.

The device operates as follows:

On closing, the lower moving contact rises; contact is first made between the insertion moving contact 62 and the semi-mobile contact 20 of the resistance 8. The current then follows the path 62, 101, 20, 56, 54, 17, 8, 13, 7, 4, 3; the resistance 8 is then well inserted on closing.

The movement of the semi-mobile assembly is braked by the damping device constituted by the drum 52 and the bell-shaped part 51, this preventing bouncing.

The movement of the semi-mobile assembly causes contact between the insertion contact 102 of the second resistance 103 with the sliding contact 104. Therefore the resistance 103 is then connected in parallel with the resistance 8.

Then contact is made between the moving burning tip 34 and the stationary burning tip 21. This shunts the two resistances 8 and 103 and the current then passes via 34, 21, 5, 3 and 3'. Lastly, the main contacts 32 and 22 close in their turn.

When the circuit opens, the semi-mobile device is moved by the action of the spring, the movement being slowed down by the damping device 44–50; the contacts are therefore separated firstly between 101 and 62, then between 32 and 22, the entire current then circulating between 34 and 21 which are separated in their turn, giving rise to an arc; the resistances 8 and 103 do not therefore take part in opening the circuit-breaker.

The duration of the insertion of the resistance 103 when the circuit-breaker closes is adjustable firstly by moving the drum 52 on the rod 18 and secondly by the position of the contact 104.

We claim:

1. A compressed gas circuit-breaker comprising:

a resistance, a tubular stationary contact, a tubular moving contact, an insertion device for inserting said resistance in a circuit including said circuit-breaker when the circuit-breaker closes, the insertion device and the resistance being disposed in a coaxial casing, means responsive to movement of said moving contact for controlling the device, said insertion device being of the semi-mobile type and having a first means for damping its movement during circuit-breaker closing and a second means for delaying its movement when the circuit-breaker opens, and wherein the first means and the second means comprise gas pressure damping means which operate by gas pressure reduction.

2. A compressed gas circuit-breaker according to claim 1, wherein the first means and the second means include in common a bell-shaped part which is integral with the insertion contact, said bell-shaped part operatively engaging a stationary drum which slides in the bell-shaped part to provide damping on closing, said bell-shaped part having a flange which, when the circuit-breaker closes is engageable in a stationary bore and slidable therein the delay the movement of the insertion device relative to said stationary drum when the circuit-breaker opens.

3. A circuit-breaker according to claim 1 or claim 2, wherein the first means includes a device for adjusting the spacing between a semi-mobile insertion contact of the insertion device and a moving insertion contact of the moving contact, and a spring acting on said insertion devied which urges said insertion device bell-shaped part in the opening direction.

4. A circuit-breaker according to claim 1 or 3, wherein the buring tip is fixed to the stationary contact by means of a support which has three radial arms and three stringers are disposed in the gaps between them with said stringers supporting the semi-mobile insertion contact.

5. A circuit-breaker according to claim 1 or claim 4, wherein the resistance is constituted by a central stack disposed in series with several peripheral stacks connected in parallel.

6. A circuit-breaker according to claim 5, wherein the end-to-end resistance of the peripheral stacks as a whole is equal to that of the central stack.

7. A circuit-breaker according to claim 1 or claim 6, further including a second resistance and a contact for inserting the second resistance in parallel with the first resistance, the insertion contact of the second resistance being integral with the insertion device of the first resistance.

8. A circuit-breaker according to claim 7, wherein the contact for inserting the second resistance is tubular and engages a contact which is connected to the second resistance and means for adjustably positioning said contact to make the duration of insertion of the first resistance vary.

9. A circuit-breaker according to claim 8, wherein the contact for inserting the second resistance is coaxial with the contact for inserting the first resistance.

10. A circuit-breaker according to claim 7, wherein the contact for inserting the second resistance is fixed to the insertion device by means of arms disposed between the arms of the stationary contact.

11. A circuit-breaker according to claim 7, wherein the second resistance is constituted by a stack of annular components disposed coaxially around the first resistance.

* * * * *